US005269223A

United States Patent [19]

Mattsson et al.

[11] Patent Number: 5,269,223

[45] Date of Patent: Dec. 14, 1993

[54] PIEZOELECTRIC FUSE SYSTEM WITH SAFE AND ARM DEVICE FOR AMMUNITION

[75] Inventors: Kjell V. Mattsson, Oakland, Calif.; Robert Rehmann, Neerach; Rudolf Zaugg, Lohn, both of Switzerland

[73] Assignee: Ems-Patvag, Domat, Switzerland

[21] Appl. No.: 957,539

[22] Filed: Oct. 6, 1992

[51] Int. Cl.[5] ..... F42C 11/02; F42C 15/26; F42C 15/22

[52] U.S. Cl. ..... 102/210; 102/231; 102/244; 102/254

[58] Field of Search ..... 102/206, 210, 231, 237, 102/244, 254, 262, 272

[56] References Cited

U.S. PATENT DOCUMENTS

| | | | |
|---|---|---|---|
| 3,359,904 | 12/1967 | Nerheim | 102/210 |
| 3,653,324 | 4/1972 | Furiani et al. | 102/215 |
| 3,742,854 | 7/1973 | Donahue et al. | 102/397 |
| 3,765,340 | 10/1973 | Brothers | 102/262 |
| 3,808,975 | 5/1974 | Stutzle et al. | 102/210 |
| 3,850,102 | 11/1974 | Morrow | 102/210 |
| 3,954,061 | 5/1976 | Rudenauer et al. | 102/210 |
| 3,967,555 | 7/1976 | Gawlick et al. | 102/210 |
| 4,550,661 | 11/1985 | Rehmann | 102/251 |
| 4,723,087 | 2/1988 | Fox et al. | 310/329 |
| 4,739,705 | 4/1988 | Hudson et al. | 102/222 |
| 4,796,532 | 1/1989 | Webb | 102/233 |
| 4,843,965 | 7/1989 | Merzals | 102/254 |
| 4,848,234 | 7/1989 | Farace et al. | 102/221 |
| 4,869,172 | 9/1989 | Webb | 102/233 |

*Primary Examiner*—Ian J. Lobo

*Attorney, Agent, or Firm*—John R. Wahl; Paul Weinstein

[57] ABSTRACT

A self-powered fuze apparatus for a projectile containing an explosive charge which comprises a first housing containing a mechanical safety device for releasably preventing undesired movement of a detonator cup holder containing a detonator from an unarmed to an armed position wherein the detonator cup is shielded from the charge to be exploded in the unarmed position and the detonator cup communicates with the charge only in the armed position and the second housing adjacent the first housing containing an electronic safety means for sensing target impact and projectile launch and selectively passing a piezoelectrically generated firing current to the detonator cup only upon sensing a predetermined magnitude target impact only within a predetermined time after sensing the launch acceleration and only when the electronic means is electrically and mechanically connected to the detonator cup in the armed position.

64 Claims, 8 Drawing Sheets

PIEZOELECTRIC FUSE SYSTEM WITH SAFE AND ARM DEVICE FOR AMMUNITION

BACKGROUND OF THE INVENTION

1. Field of the Invention

The present invention relates to an improved mechanical and electrical safety device for arming and detonating a fuze in ammunition and rendering the fuze inert under prearranged conditions.

2. Description of the Related Art

A number of safety devices and arming devices have been utilized on ammunition to prevent inadvertent detonations. For example, projectiles such as grenades, rockets, large caliber ordnance, and aircraft carried bombs have utilized various arming mechanisms which only arm the explosive device upon sensing appropriate accelerations and decelerations which would be characteristic of launch and impact with an intended target.

Some safe and arm devices are purely mechanical in nature, relying upon centrifugal effects. Typical mechanical devices are disclosed in U.S. Pat. No. 3,742,854; 4,796,532; and 4,869,172.

Other safe and arm devices have been designed to electronically sense launch, velocity, and impact, and in so doing, arm and detonate the main explosive charge. U.S. Pat. No. 3,359,904 issued to Nerheim, discloses a fuze which utilizes a piezoelectric crystal compressed by the set back forces on launch to produce a charge which is stored in a capacitor. Upon impact, a second piezoelectric crystal is compressed which generates a charge to actuate an electronic switch to discharge the capacitor previously charged upon launch.

Another electronic device, described in U.S. Pat. No. 3,653,324 issued to Ferlani et al, utilizes two transducers to sense the peculiar signature which results from a projectile launch. The first transducer is a set back sensing piezoelectric crystal and the second is a barrel exit sensing transducer. Upon receipt of a signal proportional to the correct launch acceleration followed by a signal representative of barrel exit, a switch is closed to actuate a separate arming device.

U.S. Pat. No. 3,808,975, discloses a piezoelectric crystal powered fuze circuit using a pair of back to back piezoelectric crystal cells in which the cells develop a potential upon acceleration of the projectile and then develop a reverse potential upon relaxation of the acceleration when the projectile emerges from the firing weapon. Thus, the piezoelectric cells sense projectile launch and muzzle exit to arm the device. A third piezoelectric cell or element is utilized to sense impact and detonate the device.

U.S. Pat. No. 3,850,102, issued to Mauro discloses a single piezoelectric crystal which is adapted to perform three functions. First, the crystal is compressed in one direction by the set back force of launch to produce a first voltage signal. During flight it senses the air impinging upon the launched projectile, thus generating a second lower voltage signal. Finally, it is compressed in the opposite direction upon impact to trigger the projectile detonation.

U.S. Pat. No. 3,967,555 issued To Gollick et al discloses a battery operated piezoelectric fuze which has a piezoelectric element to convert the mechanical shock of impact and into a detonator ignition signal. An arrangement of two diodes and a thyristor prevent detonator actuation if the shock wave produced upon impingement of the fuze is less than a threshold value to prevent unintended ignition but also provide ignition without there having been a response by the piezoelectric element such as upon impact. In this case, the piezoelectric element merely controls the switch between the battery power supply and the detonator.

In U.S. Pat. No. 4,723,087, a piezoelectric polymer ring is utilized to sense impact at virtually any angle and generate a voltage to ignite the detonating charge.

Another device, disclosed in U.S. Pat. No. 4,739,705 issued to Hudson et al, requires power from a missile battery. The accelerations of the missile due to an expulsion motor and a boost motor are sensed. In addition, Hall sensors are utilized in conjunction with an inertial wheel to provide a signal proportional to velocity and distance which after a predetermined distance, causes the detonator to be armed and aligned with the warhead stem.

Another example in which a piezoelectric crystal is used is disclosed in U.S. Pat. No. 4,848,234 issued to Farace et al. In this patent, a piezoelectric crystal is utilized to sense the spin rate of a projectile.

There remains a need for a fuze system which requires no external power or wires, has redundant safety features, and will reliably sense projectile launch and discriminate between launch and handling or mishandling accelerations and at the same time be able to render the projectile inert in the event that the intended target is not impacted after a successful launch mechanically arms the fuze.

SUMMARY OF THE INVENTION

The fuze apparatus in accordance with the present invention is a piezoelectric contact fuze system which requires no external power, or wires, and uses the launch, flight, and target impact accelerations in order to safe, arm, and detonate. The fuze system of the invention contains a dud-safe electrical circuit that electrically disables the fuze after a predetermined period following launch, typically about 5 seconds, if either a launch malfunction should occur or the projectile fails to hit the target. In addition, a mechanical safe and arm device is provided. Thus the fuze of the invention has three parts: a mechanical safe and arm device, a self powered electronic safety device and a self powered initiating device.

The fuze system in accordance with the present invention is particularly designed to be used in modern tandem warhead designs. In such an environment, a separate precursor charge fuze system and main charge fuze system are required. Each can operate independently, providing their own power and each sensing the launch environment and impact environment individually. A built-in time delay is provided in the electronic detonating circuit of the main charge fuze system. In addition, each fuze system in accordance with the invention includes a novel, positive detonating pin contact lock which prevents a misfire of the main charge due to contact bounce during precursor charge detonation.

The mechanical safe and arm (S & A) device is briefly described herein and is more fully described in U.S. Pat. No. 4,550,661 which is hereby incorporated herein by reference in its entirety. The mechanical safe and arm device disclosed in U.S. Pat. No. 4,550,661 constitutes a portion of the fuze system in accordance with the present invention. This safe and arm device has been modified to add special contacts which hold under shock load conditions, and incorporate portions of a dud-safe piezoelectric firing circuit.

The mechanical S & A device has two independent safeties. It has an inertial mass lock and a separate locking arrangement which together permit mechanical arming only upon sensing a proper projectile launch acceleration and its duration and a proper flight acceleration and its duration.

The mechanical S & A device has a metal housing with a cylindrical bore therethrough containing a spring biased holder in which a primer type electrical hot wire detonator cup is mounted.

The inertial mass lock includes three parallel bores in the holder. A piston slides in the middle bore. Two spring urged lock pins are slidably mounted in the outer bores and extend out of the holder. These pins and the piston engage corresponding blind bores in the device housing to lock the holder in the safe rotational position. These parallel bores are aligned axially in the direction of launch acceleration. If the munition projectile is fired from a gun or otherwise launched with normal high acceleration, inertial force causes the lock pins to retract; permitting the piston to also retract, thus releasing the holder and allowing it to rotate toward the armed position.

The second mechanical locking arrangement in the S & A device housing comprises an offset bore in the housing arranged approximately in line with the direction of acceleration. A conical bolt is slidably positioned in the bore in an axial direction. A biasing device (a spring) normally urges the bolt in the direction of launch acceleration so as to extend the bolt into a partial circumferential groove formed in the detonator holder. The bolt moves against the spring out of the groove in the rotor due to inertial force during conditions of normal firing acceleration. This permits the holder to rotate fully to the armed position.

In other words, when the projectile containing the fuze in accordance with the present invention is fired on a ballistic trajectory, the detonator holder or rotor, initially locked by the inertial mass lock (described in full detail in U.S. Pat. No. 4,550,661) is unlocked by the acceleration forces and undergoes, from the starting safe position as shown in FIG. 1, a clockwise rotation. These forces also act on the conical bolt whereby the latter is retracted, due to its mass, against spring pressure out of engagement with the groove in the detonator cup holder.

The bolt is kept in the retracted position under normal firing accelerations, during which the forces are high enough, for a sufficient time so that the full 270° rotation of the holder to the armed position occurs. Rotation of the detonator cup rotor through the full 270° is retarded by a ball and balance wheel arrangement whereby the balance wheel executes an oscillating escapement movement to create a rotational drag on the holder. The delay time of 270° rotation required may range from a few milliseconds to several seconds, depending on the projectile, the design of the retard mechanism, and needs of the particular weapon system.

As the rotor reaches the armed position, a telescoping contact of the electronic safety device slides into the bore of the detonator rotor and onto the detonator cup pin contact. The socket contact from the electronic safety device thus latches onto the pin contact with internal barbs or prongs so that it is firmly engaged and will not jump off or out of the engagement due to shock produced, for example, by detonation of a precursor charge.

If the flight acceleration is below the normal or expected conditions, or if the flight of the ammunition round is stopped prematurely, by impinging on an obstacle, or the acceleration was due to a droppage of the projectile, the conical bolt is pushed back into the groove and stops the detonator holder from rotating fully through the 270° and therefore stops the detonator cup short of the armed position. Accordingly, there are two separate mechanical means which sense launch and flight acceleration. These are the inertial mass lock and the spring bias bolt above-described.

The fuze apparatus in accordance with the present invention basically comprises a first housing which contains a mechanical safety device as above described for releasably preventing undesired movement of the detonator cup holder containing a detonator cup from an unarmed to an armed position and a second housing containing an electronic safety device. The detonator cup is shielded from the explosive charge to be exploded in the unarmed position. The detonator cup is in line with and communicates with the charge to be exploded only when rotated into the armed position.

The second housing, adjacent the first housing, contains an electronic safety device which is electrically and mechanically coupled to the mechanical safety device. The electronic safety device electrically senses and recognizes appropriate launch accelerations and selectively passes a piezoelectrically generated firing current to the detonator cup only: 1) upon sensing an impact of a predetermined magnitude, 2) within a predetermined time after launch, and 3) only after sensing a predetermined launch-acceleration value.

Finally, the electronic safety device is also continuously electrically and mechanically connected to the detonator cup only when the detonator cup rotor is in the armed position.

The electronic safety device is a piezoelectrically powered integrated circuit which compares a piezoelectrically generated charge at launch to a reference voltage to either permit or inhibit a thyristor switch from passing another piezoelectrically generated firing current, generated upon target impact. The device utilizes a small piezoelectric sensor to sense launch and charge a first capacitor which then decays through an RC network. The voltage on this capacitor is fed to a comparator circuit. This comparator circuit compares the charge remaining on the first capacitor with a reference value. If the charge remaining is greater than the reference, then the comparator will signal a thyristor switch to fire when a target impact of predetermined magnitude is sensed by a second piezoelectric sensor. Thus, the electronic circuit will fire only upon target impact and only after sensing adequate launch acceleration and only within the predetermined time after launch.

Further features, objects and advantages of the invention will become apparent from the following detailed description when taken in conjunction with the accompanying drawing.

DETAILED DESCRIPTION OF THE PREFERRED EMBODIMENTS

Figure 11:
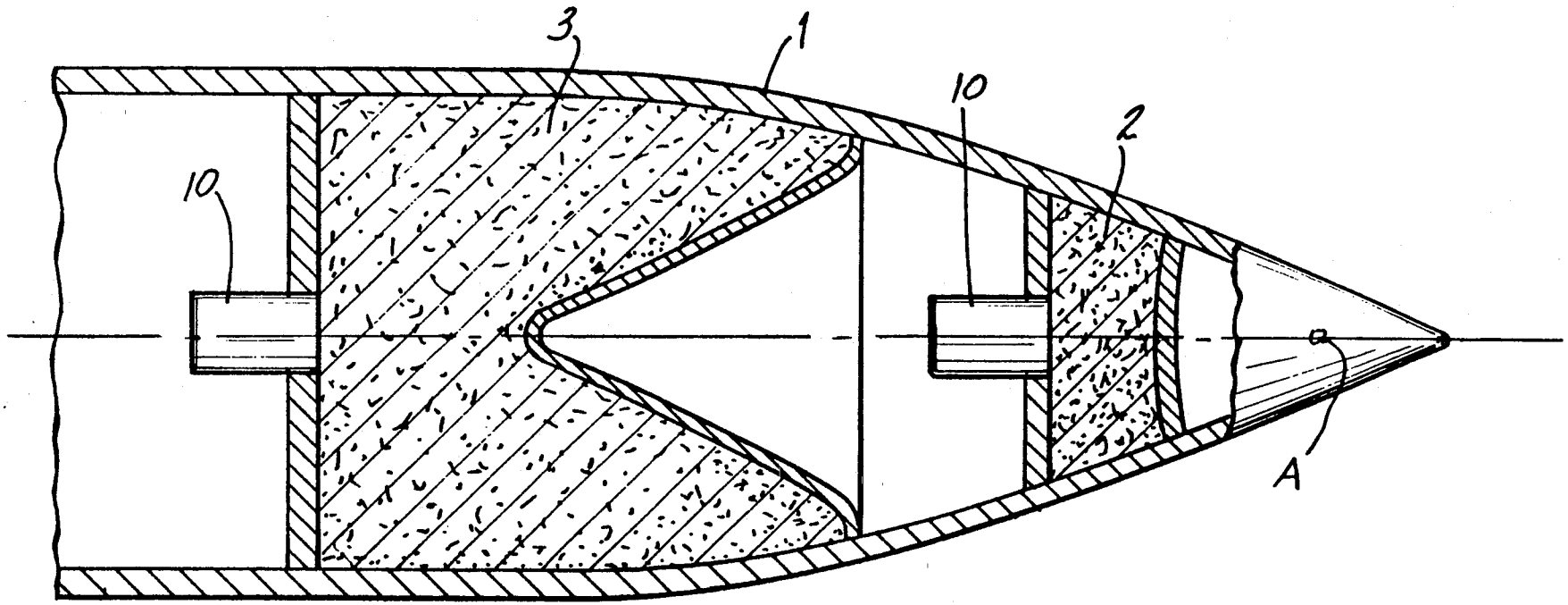
FIG. 11 is a partial longitudinal sectional view of a simplified tandem warhead utilizing two fuze apparatii in accordance with the present invention.

A simplified tandem warhead projectile I is shown in FIG. 11 illustrating the typical location of a fuze apparatus 10 in accordance with the present invention with respect to the explosive charge to be detonated. In this example, the warhead projectile 1 has a precursor explosive charge 2 coaxially aligned in front of a main shaped charge explosive device 3. Each explosive device 2 and 3 has a fuze apparatus 10 in accordance with the present invention mounted so as to abut the rear face of the explosive charge 2 or 3 in a conventional manner. The fuze apparatus 10 abutting the aft face of the main charge 3 includes a time delay described below which delays the main charge detonation until the precursor charge 2 has detonated and defeated any reactive or active armor on the intended target.

Figure 1:
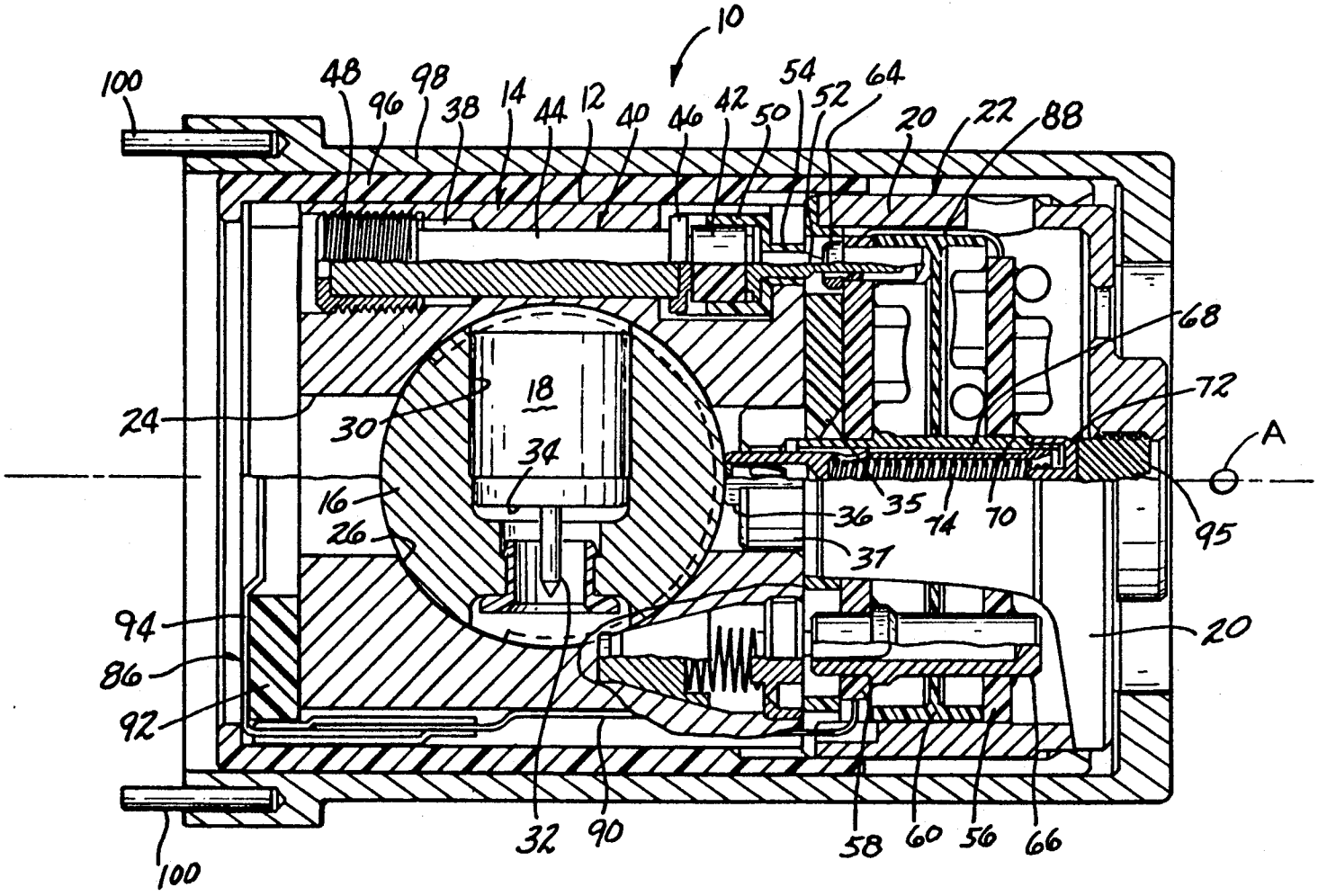
FIG. 1 is a longitudinal sectional view of the fuze apparatus in accordance with the invention with portions partially broken away to illustrate various sub components in the safe position.

One preferred embodiment of the fuze 10 in accordance with the present invention is illustrated in FIG. 1. Fuse apparatus 10 is preferably oriented in a projectile 1 along or parallel to the central axis A of the projectile 1. The reader should note that, as viewed in FIG. 1, the nose of the projectile will be oriented to the left, which is opposite to that shown in FIG. 11.

The self-powered fuze apparatus 10 comprises a first housing 12 which includes a mechanical safety device 14 for releasably preventing undesired movement of a detonator cup holder 16 containing a detonator cup 18 from an unarmed to an armed position. The detonator cup 18 is shielded from the charge to be exploded in the unarmed position as illustrated in FIG. 1. The detonator cup 18 communicates with the charge to be exploded only when fully in the armed position in which the holder 16 is rotated 270° clockwise from the position shown in FIG. 1.

Fuse apparatus 10 also includes a second housing 20 coaxially positioned adjacent housing 12. Housing 20 contains an electronic safety device 22 which is electrically and mechanically coupled to the mechanical safety device 14 for sensing launch target impact and selectively passing a piezoelectrically generated firing current to the detonator cup 18 only upon sensing target impact of a predetermined magnitude. The firing current is only passed to the detonator cup 18 only if it occurs within a predetermined time after sensing a predetermined launch acceleration value and only if the electronic device 22 is electrically and mechanically connected to the detonator cup 18. This latter condition occurs only when holder 16 is in the armed position (which is rotated 270° clockwise from that shown in FIG. 1).

The mechanical safety device 14 includes a right circular cylindrical housing 12 having a central axial bore 24 therethrough having one open end open to the charge to be ignited (left end in FIG. 1) and the other open to the electronic safety device 22. The housing 12 also had a transverse bore 26 containing a spring biased, cylindrical detonator holder 16. This holder 16 has a central transverse bore 30 containing a conventional detonator cup 18 which has a pin contact 32 protruding from the base 34 of the cup 18. Opposite the base 34, the detonator cup 18 is open. The detonator cup 18 contains an ignition charge and an explosive bridge wire embedded therein connected to the pin contact 32.

First housing 12 and second housing 20 are coaxially aligned and tandemly arranged via an annular insulating spacer 35 so that the central axial throughbore 24 is aligned with a corresponding socket contact 36 from the electronic safety device 22. Contact 36 passes through a central hub 37 of spacer 35 which fits into the through bore 24. When the holder 16 is rotated clockwise through an arc of 270°, the open end of the detonator cup 18 is then positioned in line with the throughbore 24 so as to communicate with the charge to be ignited. In addition, the pin contact 32 on the detonator cup 18 is in line with and engages the corresponding socket contact 36 from the electronic safety device 22 which will be described in greater detail below.

The housing 12 for the mechanical safety device 14 also includes a partially threaded throughbore 38 which is radially offset from the transverse bore 26 containing the detonator cup holder 16 and parallel to central axis A. This offset, partially threaded bore 38 contains a first piezoelectric sensor assembly 40.

Figure 2:
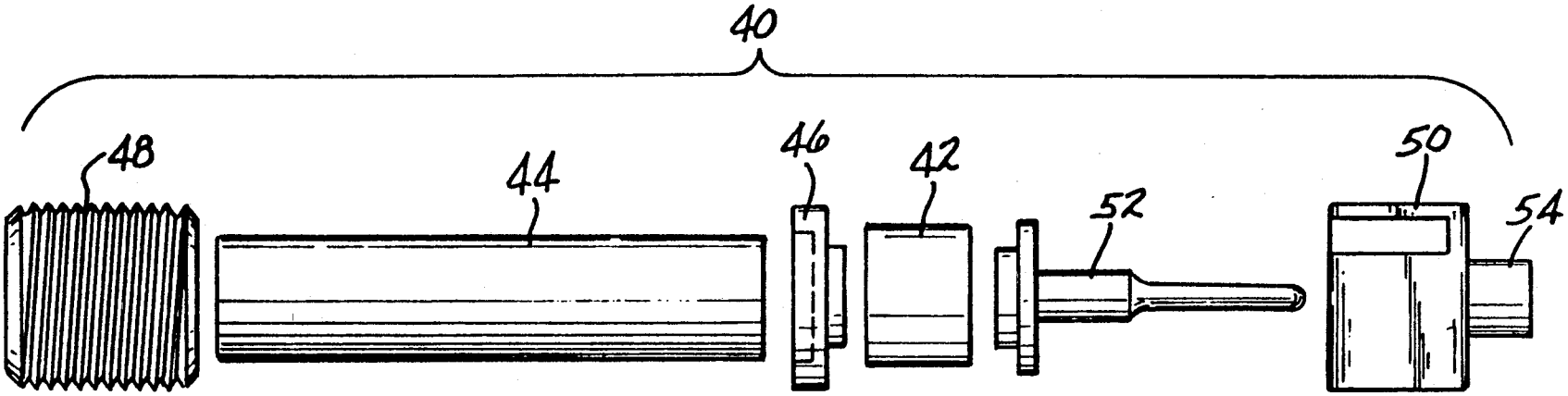
FIG. 2 is an exploded longitudinal view of the first piezoelectric cell assembly in accordance with the invention.
Figure 3:
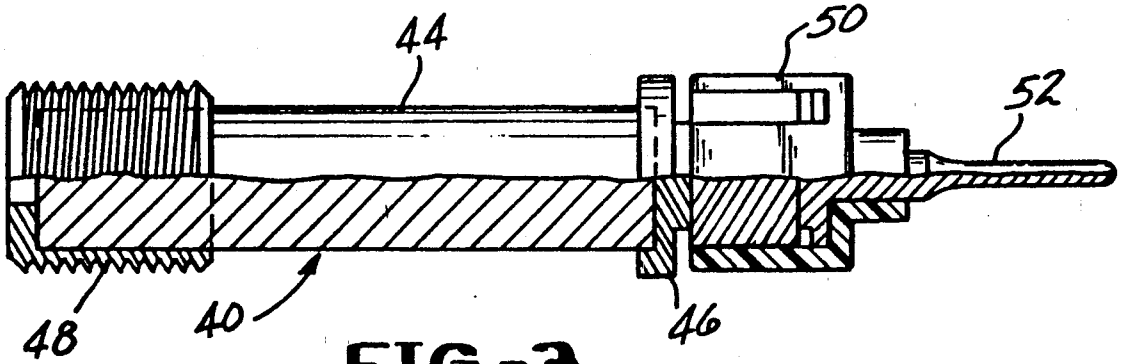
FIG. 3 is an assembled longitudinal view of the first piezoelectric cell shown in FIG. 2.

Referring now to FIGS. 2 and 3, this first sensor comprises a generally square block of preferably ceramic piezoelectric material 42 and an elongated cylindrical inertial mass 44 made of heavy metal which is slidably disposed in the offset bore 38. Block 42 is mounted at one end of bore 38. One end of the mass 44 freely contacts a metal area multiplier disk 46 which in turn contacts one side of the piezoelectric block 42. The other end of mass 44 is supported by a tubular closure screw 48 threaded into the other end of the bore 38. The tubular closure screw 48 also retains the inertial mass 44 so that it is free to move axially within the bore 38. The composition and size of mass 44 and disk 46 may be varied in order to produce a desired charge from the piezoelectric block 42 upon normal projectile acceleration.

An insulating box 50 retains the piezoelectric adjacent the area multiplier and one end of the mass 44 in the bore 38. Box 50 is a one piece, five sided box, preferably made of PEEK (polyesterethylketone). In contact with the other side of the cylindrical piezoelectric block 42, is an electrical contact pin 52 which projects through a coaxial sleeve portion 54 of the insulating box 50 and extends out of the end of the mechanical safety device housing 12. Pin 52 projects into a corresponding socket contact 64 in the electronic safety device 22.

The first piezoelectric sensor 40 is oriented with the mass 44 forward of the piezoelectric block 42 so that the inertial mass 44 presses against the piezoelectric block 42 only upon normal forward acceleration of the projectile. During side acceleration (droppage) or reverse direction acceleration (such as target impact or droppage), the inertial mass 44 moves away from the piezoelectric block 42 and thus does not produce the necessary positive electrical charge.

Figure 5:
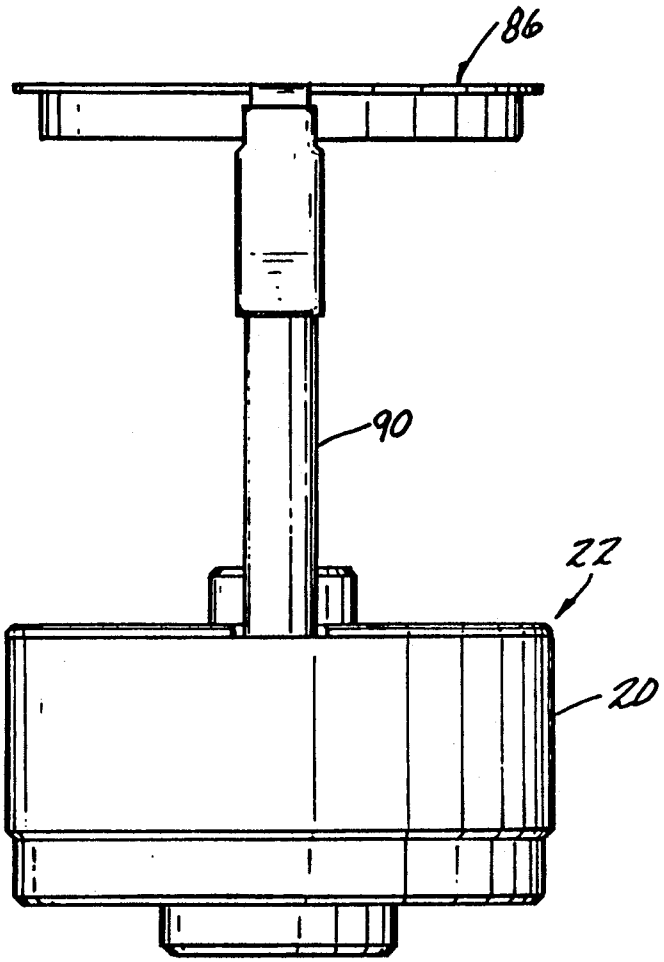
FIG. 5 is a side view of the electronic safety assembly shown in FIG. 4.

Returning to FIG. 1, most of the components of the electronic safety device 22 are contained in the second housing 20 which has a generally cylindrical cup shape. Housing 20 is positioned in tandem with the first housing 12 and is insulated therefrom by spacer 35. The electronic safety device 22 includes first piezoelectric sensor assembly 40, a second piezoelectric sensor 86, and the electronic circuit components contained in housing 20. The electronic safety device 22, without sensor assembly 40, is separately shown in FIGS. 4 and 5.

Housing 20 contains a pair of spaced electronic circuit boards 56 and 58 and three spaced electrical socket contacts 64, 66, and 68. The first of these contacts is a stationary socket contact 64 which engages the pin contact 52 protruding from the first piezoelectric sensor assembly 40. A second stationary socket contact 66 engages a ground or common pin projecting from the housing 12 of the mechanical safety device 14. A third socket contact 68 has a telescoping socket contact 36 which connects to pin 32 when the fuze 10 is in the armed position.

Figure 6:
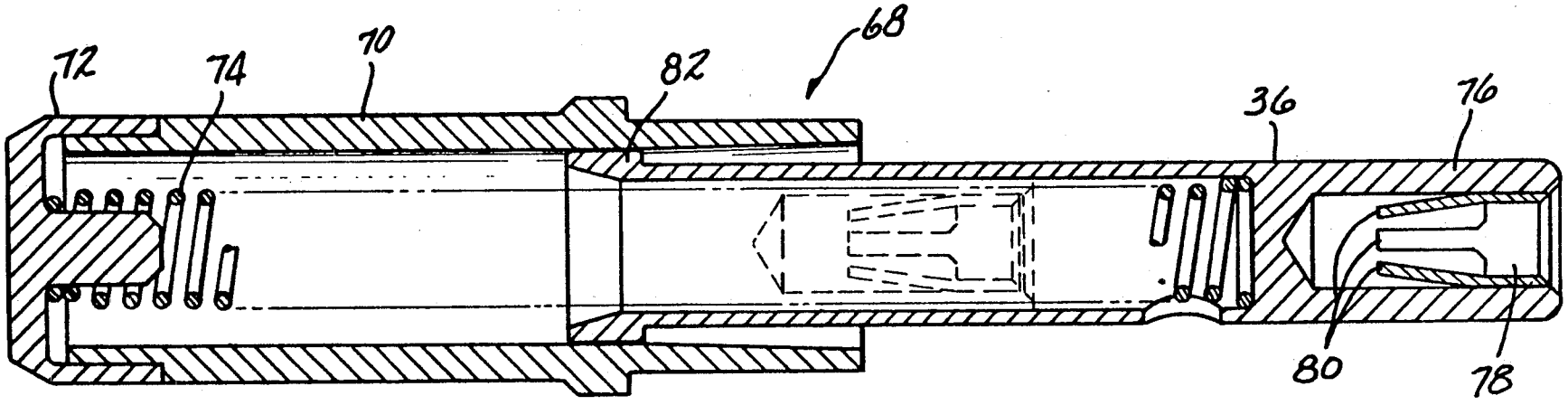
FIG. 6 is a longitudinal sectional view of the socket contact assembly in accordance with the invention.

Socket contact 68 is separately shown in a sectional view in FIG. 6. Socket contact 68 comprises the tubular sleeve 70 which has a closure cap 72 at one end and socket contact 36. The sleeve 70 of contact 68 is soldered to each of the circuit boards 56 and 58. Socket contact 36 telescopically slides within sleeve 70 and is biased toward the extended position via spring 74 having one end mounted within sleeve 70 and the other end within the sleeve end of socket contact 36.

Figure 4:
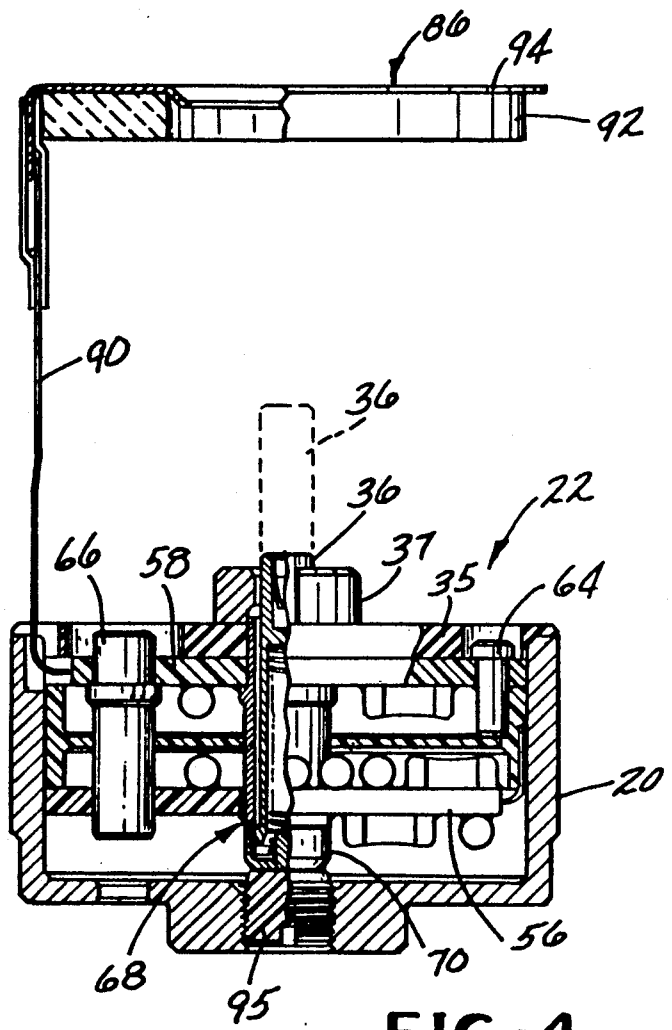
FIG. 4 is a partial sectional view with portions broken away of the electronic safety assembly separate from the mechanical safety assembly in accordance with the invention.

Contact 36 is shown retracted in FIG. 4. The extended position is illustrated by the dashed lines. In FIG. 6, contact 36 is shown in the extended position as would be the case if fuze 10 were in the armed position. Contact 36 would be retracted to the position as is shown in FIGS. 1 and 4 when the fuze 10 is in the safe position. In that position, the open end 76 of the contact 36 is biased against the outside surface of the detonator holder 16 so that it can immediately engage pin contact 32 when holder 16 is in the armed position.

Open end 76 of contact 36 has a rearwardly barbed, press fit sleeve 78 inserted therein preferably made of beryllium copper. Sleeve 78 has either 3 or 4 spring prongs or barbs 80 which allow insertion of pin 32 but dig into the surface of pin 32 to prevent disengagement of socket contact 36 with pin 32. When the detonator cup holder 16 rotates to the armed position, the socket contact 36 snaps forward, over and onto the protruding pin contact 32, whereby the inwardly projecting prongs 80 dig into the surface of the pin contact 32 to securely fasten the socket contact 36 and pin contact 32 together.

This action is extremely important where the fuze 10 in accordance with the present invention is utilized in a projectile having at least two charges that are separately detonated, with one being a "precursor charge" designed to destroy reactive armor prior to the detonation of the main charge. In this case, contact pin bounce must be prevented. The pin and socket contact arrangement in accordance with the present invention prevents such pin bounce in these types of dual explosive charge warhead designs. Thus, once the fuze 10 is placed in the armed condition, there is no potential for inadvertent disarming of the fuze. This positive gripping provided by the prongs 80 prevent contact bounce in the situation where the fuze 10 is associated with a main charge where the precursor charge shock would otherwise momentarily dislodge a connection between pin 32 and socket 36 at the instant of time that the main charge detonating current is passed.

Contact 36 is a preferably gold plated tubular body with a transverse partition separating opposite open ends. One open end 76 contains the press fit sleeve 78. The other open sleeve end receives spring 74. This end includes a contact guide ring 82 which maintains sliding electrical contact between the socket 36 and sleeve 70.

Figure 7:
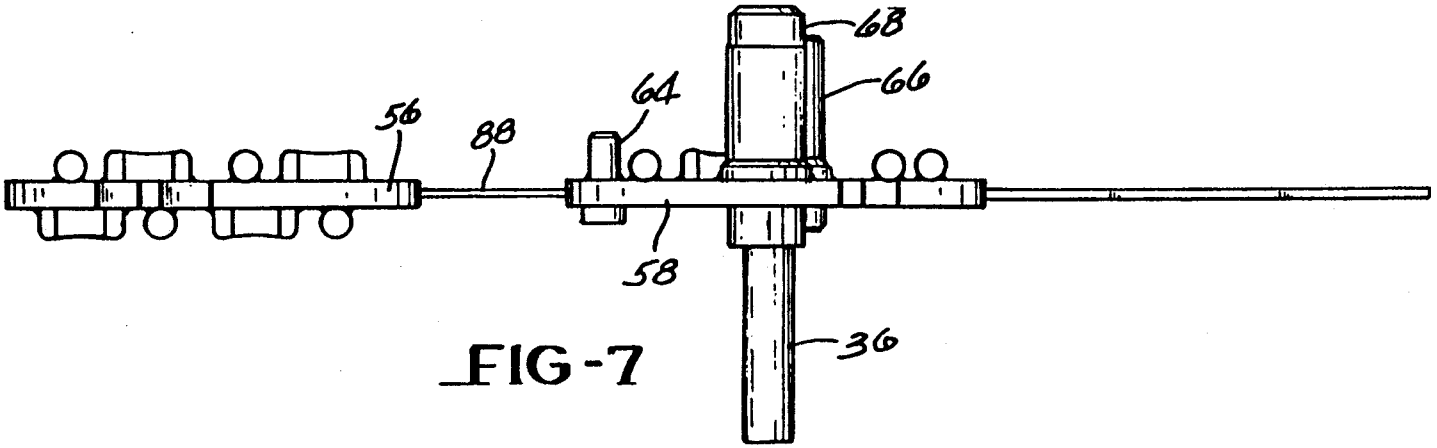
FIG. 7 is a side view of the electronic circuit assembly prior to assembly into the housing illustrated in FIG. 1.
Figure 8:
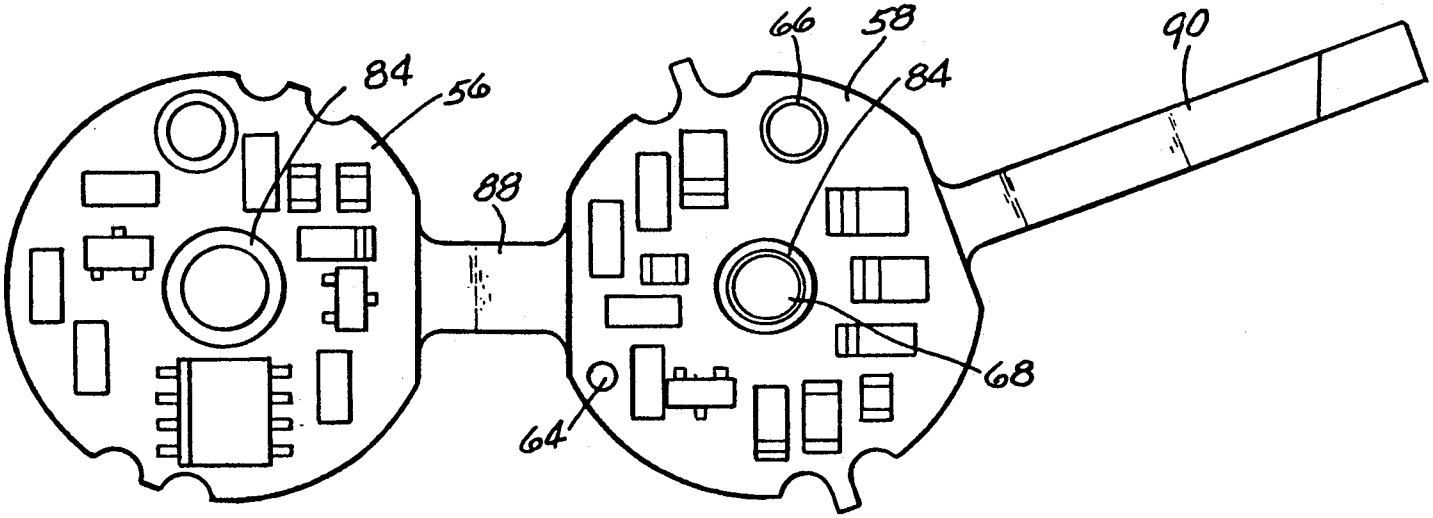
FIG. 8 is a top view of the electronic circuit board assembly shown in FIG. 7.

The circuit boards 56 and 58 are shown in FIGS. 7 and 8 prior to assembly into housing 20. Each of the electronic circuit boards 56 and 58 is a circular disk of conventional circuit board material with a central ring contact surface 84. The two circuit boards 56 and 58 are stacked and spaced from one another by a disk shaped spacer 60 having a tubular rim. Thus spacer 60 has an H-shaped cross section. The two circuit boards 56 and 58 are electrically connected together by ribbon lead 88 and the central contact sleeve 70 which is soldered to the two ring contacts surfaces 84.

Figure 9:
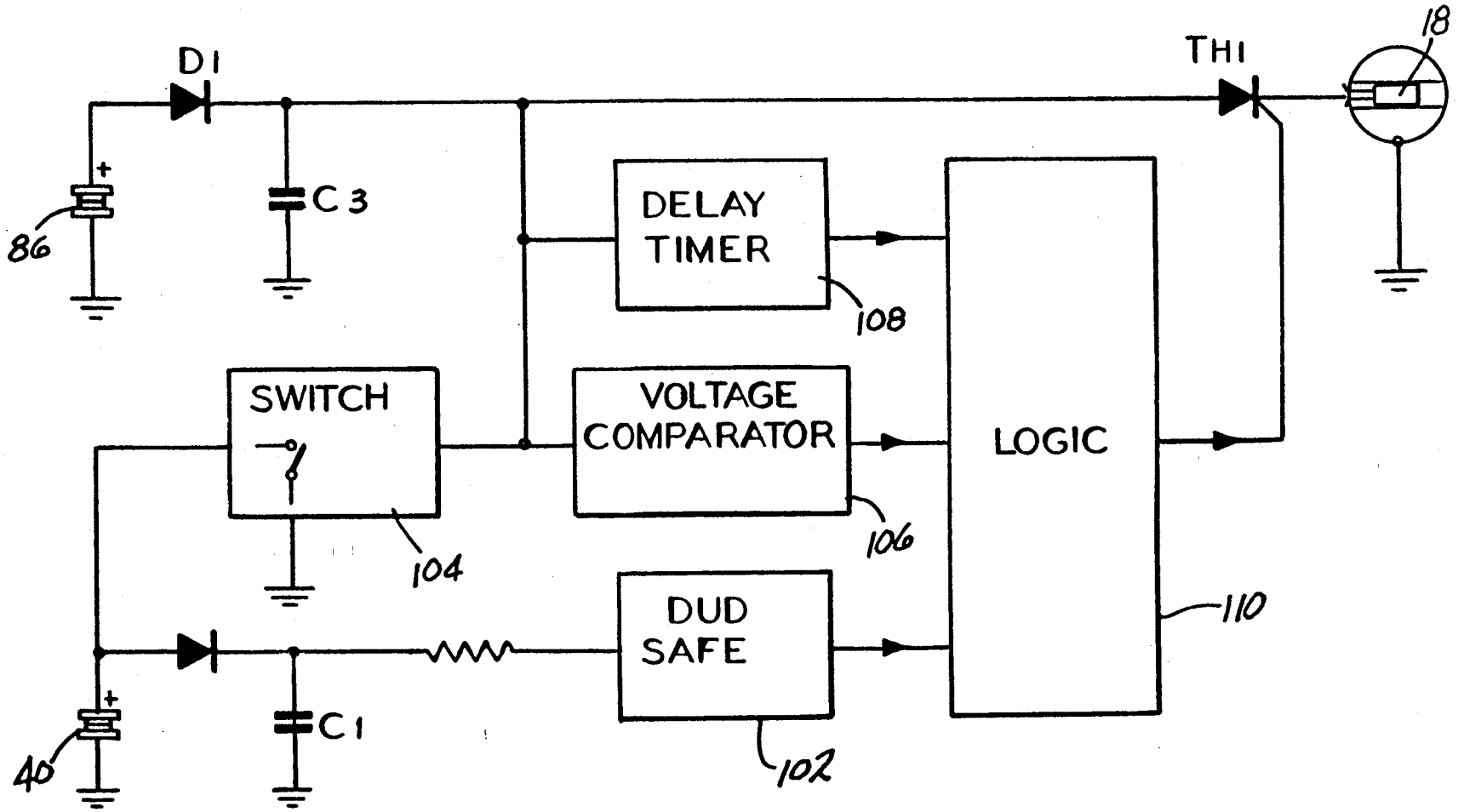
FIG. 9 is a block diagram of the electronic safety device in accordance with the invention.
Figure 10:
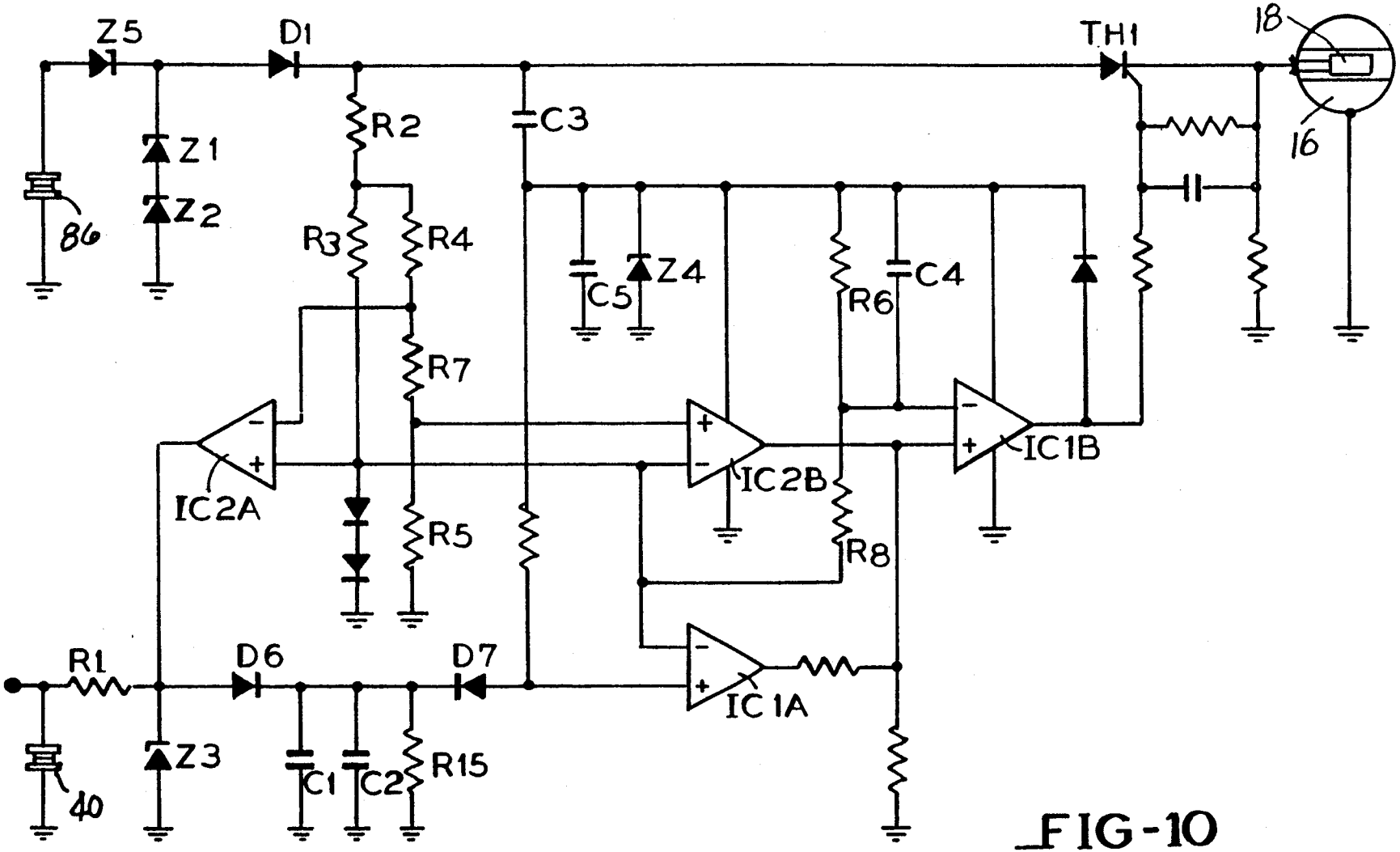
FIG. 10 is a schematic diagram of the electronic safety device in accordance with the present invention.

Each of the generally circular circuit boards 56 and 58 supports integrated circuits, capacitors, resistors, and diodes and provides the connections therebetween, for the electrical circuit schematically shown in FIGS. 9 and 10. The two circuit boards and the three contacts comprise an electronic comparator circuit for comparing the electrical charges generated by the first piezoelectric sensor on launch and by a second piezoelectric sensor 86 on target impact and routing the required firing current to the detonator cup 18.

The electrical components mounted on circuit boards 56 and 58 are connected together via ribbon lead 88 and sleeve 70. The second piezoelectric sensor 86 is connected to the circuit boards 58 via a single insulated ribbon lead 90.

Referring back to FIGS. 4 and 5 and FIG. 1, the second piezoelectric sensor 86 is a flat, washer shaped, annular disk 92 of preferably ceramic piezoelectric material positioned against the forward end of the housing 12 of the mechanical safety device 14. A conductive metal washer 94 is bonded to the forward or outer face of the annular disk 92 of the second piezoelectric sensor 86. The conductive metal washer 94 is connected to circuit board 58 via the lead 90 and rests against the body of an explosive charge device (not shown) when the assembled fuze 10 is installed in a projectile.

An adjustment screw 95 is threaded into the top of the housing 20. The screw 95 is used to compensate for manufacturing tolerences in the components housed within housing 20 including the circuit boards 56 and 58, spacers 35 and 60, and contact 68. The screw 95 is adjusted during assembly of the electronics safety device 22 to eliminate any play between the components to prevent fibration and flexing that could be extremely detrimental during launch and impact accelerations.

As is shown in FIG. 1, the assembled housing 12 containing the mechanical safety device 14 and the assembled second housing 20 containing the electronic safety device 22 are both slidably supported in an insulating sleeve 96 within an outer cup shaped metal can 98. The can 98 is fixedly mounted in the projectile (not shown). Alignment studs or pins 100 are used to align and prevent rotation of the can 98. This can 98 provides a conductive shield against rf radiation effects. The housings 12 and 20 are free to slide within the insulated sleeve 96. They are prevented from forward movement by the piezoelectric sensor 86 which is retained in sleeve 96 by a flange 102. Flange 102 and the outer washer 94 rest against the explosive charge device or body (not shown) to be detonated.

Upon initial projectile acceleration, the housing 12, the mechanical safety device 14, and the housing 20 move to the right, away from contact with the second piezoelectric sensor 86. Accordingly, no positive electrical charge is generated by this sensor 86 on launch.

On impact with the target, the mechanical and electrical safety devices 14 and 22 and their housings 12 and 20 press against the second piezoelectric sensor 86 generating a positive electrical charge which constitutes the firing current. Thus, sensor 86 utilizes the mass of both safety devices to generate the electrical firing charge and only upon deceleration of the projectile against the target. No separate inertial mass is needed. This feature minimizes unnecessary mass and volume. The device 10 of the invention is therefore extremely compact, currently measuring about 0.8 inches in diameter and 1.4 inches long.

FIG. 9 is a block diagram 100 of the novel electronic circuit in the electronic safety device 22 shown in FIG. 10. The sub-circuits comprising the blocks may be of any conventional design. However, the overall circuit shown in FIG. 10 and described below is preferred.

The electronic comparator circuit of the electronic safety device 22 basically compares the electrical charges generated by the first and second piezoelectric sensors 40 and 86 to electrically determine whether and when to pass the second sensor charge as a firing current to the detonator cup 18 to detonate the explosive charge or device.

Upon projectile launch, a current is generated by the piezoelectric sensor 40 which produces a charge on capacitor Cl. This charge on Cl is also fed into a dud-safe circuit 102 which permits the charge to decay such that it will be reduced to 80% of its full charge value in about 5 seconds. Five seconds is typically twice the projected flight time of the projectile between launch and target at maximum intended range. This time period is selected by choice of circuit components and will be varied depending upon the weapon system.

Upon target impact, the large voltage produced by piezoelectric sensor 86 is fed to capacitor C3. This voltage is also fed to a thyristor TH1, voltage comparator circuit 106 and optionally to a timer circuit 108, and to discriminator switch 104 that will short sensor 40.

The voltage comparator 106 provides an output only if the charge on C3 is greater than a reference voltage, typically 150 v. This prevents spurious currents from dropping, mishandling, etc. from being passed.

The timer circuit 108 provides a signal after a predetermined period from sensing a charge on C3. This circuit is optional and is used where a detonation delay is desired such as where target penetration is desired prior to charge detonation, or in a tandem warhead as in FIG. 11 where time must be allotted for detonation of a shaped charge precursor to occur.

The output of the time delay circuit 108, if used, and the output of the voltage comparator 106 and the output of the dud-safe circuit 102 are all fed to a logic circuit 110. Provided there is sufficient voltage signal output of the dud-safe circuit (less than 5 seconds from successful launch) and the voltage comparator circuit 106 output indicates a voltage (greater than 150 volts), and a signal is present on the output of the timer then a signal out of the logic circuit is provided to the gate of thyristor TH1. The thyristor TH1 conducts to feed the charge built up on capacitor C3, as a firing current, through socket contact 36 and pin contact 32 to the detonator 18.

The target impact shock produces a sufficient charge, voltage and current to fire the armed fuze as just described. Alternatively, if the projectile misses the target, does not impact within the dud-safe time period of 5 seconds, makes a relatively soft landing parallel to the earth or water etc, there will be insufficient voltage produced to fire the fuze. The dud-safe circuit prevents any voltage, no matter how large, produced by sensor 86 from turning thyristor TH1 on unless the launch profile is again sensed by piezoelectric sensor 40. Thus, even though the detonator holder may be in the armed position with the physical contact made, the fuze must again be subjected to the launch profile prior to being capable of being detonated upon a target impact. Thus, a spent projectile will not detonate if inadvertently picked up or run over in the field and may be easily disposed of by battlefield clearance personnel.

Detailed operation of the electronic safety device 22 is facilitated by the following discussion in conjunction with the schematic representation on FIG. 10. This circuit utilizes two integrated circuits IC1 and IC2 and various resistors, capacitors, and diodes to accomplish the comparator functions above described.

Initial projectile acceleration actuates the mechanical safety device 14 to the armed position as previously described. Initial projectile acceleration also activates the dud-safe circuit 102 which primarily consists of sensor 40, R1, D6, D7, Z3, C1, C2, R15, and ICIA. Initial projectile launch causes sensor 40 to generate a charge on Cl and C2 when the capacitors C3 and C5 have a voltage. The charge on capacitors Cl and C2 produces an output on ICLA and this charge slowly bleeds off through R15. A time constant on the order of 100 microseconds may be preferred by proper choice of capacitor C1, C2 and R1 values. In such case, short shock peaks of less than 50 microseconds will not activate the dud-safe circuit. Breakdown diode Z3 also limits the dud-safe circuit voltage and electrically prevents negative voltage from being applied.

The active period for the dud-safe circuit is typically selected to be about 5 seconds. Thus, the voltage on C1 and C2 is chosen to decay below the acceptable threshold value of 80% at the end of that period and the output of ICLA returns to zero.

Impact of the projectile with a target produces a charge on piezoelectric sensor 86 which is in turn passed through diode D1 onto capacitors C3 and C5. The voltage on these capacitors is limited by zener diodes Z1 and Z2. The voltage divider provided by capacitors C3 and C5 sets up a high voltage to integrated circuits IC1 (A and B) and IC2 (A and B) of about 9 volts limited by the zener diode Z4.

Comparator ICLA will have a high output if the plus input is greater than the reference voltage at the minus input, provided that the capacitors Cl and C2 have not yet discharged (the dud-safe circuit 102 is still active).

The discriminator switch circuit 104 comprises IC2A, a pair of series connected diodes, and a voltage divider network of R2 and R3. If the voltage between C3 and C5 from sensor 86 is greater than 150 volts, then the charging circuit for capacitor C1 and C2 is short circuited via IC2A discriminator switch circuit 104. As a result, activation of the dud-safe circuit 102 after target impact is prevented if it was initially inactive at the time of impact. This is done to preclude spurious ignition of the charge without there having been a successful launch within the dud-safe period.

Voltage comparator 106 basically comprises IC2B, C3, and voltage divider R2, R4, R5, and R7. Comparator IC2B will have an output that is open (zero) if the plus input is greater than the reference voltage provided the voltage of C3 is greater than 150 volts (voltage comparator 106).

Logic 110 basically comprises ICLB, the output of ICLA, the output of IC2B, capacitor C3 and voltage divider R6 and R8. Comparator ICLB (logic 110) will have an output that is high causing thyristor TH1 to fire if its negative input is lower that its positive input.

A delay timer circuit 108 may be provided to prevent firing of thyristor TH1 upon impact until a certain predetermined time period has passed, typically on the order of a millisecond or less, for a precursor charge to be detonated. Delay timer 108 consists of C4 inserted in parallel with R6. This provides an RC time delay preventing ICLB from turning on until the voltage becomes lower at the negative input than at the positive input due to C4 charging. For precursor applications requiring no delay, C4 would simply be omitted.

While the invention has been described above with reference to specific embodiments thereof, it is apparent that many changes, modifications, and variations can be made without departing from the inventive concept disclosed herein. For example, the electronic circuits above described in the individual blocks may be any conventional electronic design. In addition, the fuze apparatus may be utilized in other applications than as above described and other equivalent sensors may be substituted. Accordingly, it is intended to embrace all such changes, modifications, and variations that fall within the spirit and broad scope of the appended claims. All patent applications, patents, and other publications cited herein are incorporated by reference herein in their entirety.

What is claimed is:

1. A self powered fuze apparatus for use in an explosive device having a central axis and containing an explosive charge to be exploded, said apparatus comprising:

a detonator cup supported in said apparatus so that it is adapted to be shielded from said charge to be exploded in an unarmed position and adapted to communicate with said charge to be exploded in an armed position;

a first housing containing a mechanical safety device for releasably preventing undesired movement of said detonator cup from said unarmed to said armed position, and a second housing containing an electronic safety device electrically coupled to said mechanical safety device for sensing and selectively passing a sensor generated current to said detonator cup only upon. sensing an impact of a predetermined magnitude within a predetermined time after sensing a predetermined launch acceleration value, said electronic safety device adapted to be electrically and mechanically connected to said detonator cup only when said cup is in said armed position.

2. The apparatus according to claim 1 wherein said electronic safety device comprises a first self powered sensor and a second self powered sensor for generating said current.

3. The apparatus according to claim 2 wherein said sensors are piezoelectric cells.

4. The apparatus according to claim 2 further comprising a support housing containing said first and second housings for relative movement of said first and second housings therein in response to acceleration and deceleration forces.

5. The apparatus according to claim 2 wherein said first sensor comprises a first piezoelectric sensor being positioned so as to generate a first electrical charge only upon forward acceleration of said explosive device along said axis.

6. The apparatus according to claim 5 wherein said second sensor comprises a piezoelectric sensor positioned so as to utilize the mass of said first housing and said mechanical safety device to generate a second electrical charge only upon deceleration of said explosive device.

7. The apparatus according to claim 6 wherein said electronic safety device further comprises an electronic comparator circuit for comparing the electrical charges generated by said first and second sensors to electrically determine whether to pass said second sensor charge as a current to said detonator cup.

8. The apparatus according to claim 5 wherein said first sensor is supported in a bore in said first housing.

9. The apparatus according to claim 8 wherein said first sensor comprises a heavy rod slidably supported in said bore, said rod having one end movable against one side of a piezoelectric cell fixed in said bore, and an electrical contact connecting another side of said cell to said comparator circuit.

10. The apparatus according to claim 9 wherein said piezoelectric cell is a flat sided body of a piezoelectric material contained within an insulating box within said first housing.

11. The apparatus according to claim 10 further comprising an area multiplier between said rod and said piezoelectric cell.

12. The apparatus according to claim 2 wherein said second sensor is an annular disk of piezoelectric material supported against forward movement by said explosive device.

13. The apparatus according to claim 12 wherein said first and second housings are slidably supported within said explosive device so that upon target impact, the mass of both said housings bears upon said second sensor to generate said second sensor charge.

14. The apparatus according to claim 13 wherein said disk has a metal washer contact fastened to one side of said disk and electrically connected to said comparator circuit.

15. The apparatus according to claim 1 wherein said detonator cup has an outwardly projecting pin contact adapted to receive, only when said cup is in the armed position, a spring biased socket contact connected to said electronic safety device, said socket contact sliding over said pin contact and gripping said pin contact sufficiently to prevent contact jump during target impact.

16. The apparatus according to claim 15 wherein said socket contact is movably supported within a stationary contact sleeve electrically connected to said comparator circuit.

17. The apparatus according to claim 16 wherein said socket contact is axially disposed within said second housing.

18. The apparatus according to claim 15 wherein said socket contact has an internal extension spring inside both the sleeve and the socket contact.

19. The apparatus according to claim 15 wherein said socket contact has internally projecting metal barbs oriented to grip and engage the contact pin securely to prevent disengagement and said contact jump.

20. A fuze apparatus comprising a detonator cup having an outwardly projecting pin contact adapted to receive a spring biased socket contact connected to an electronic safety device only when said cup is in an armed position, said socket contact sliding over said pin contact and gripping said pin contact sufficiently to prevent inadvertent separation of said contacts.

21. The apparatus according to claim 20 wherein said socket contact is movably supported within a stationary contact sleeve.

22. The apparatus according to claim 21 wherein said socket contact has an internal extension spring inside both the sleeve and the socket contact.

23. The apparatus according to claim 20 wherein said socket contact has at least three internally projecting metal barbs oriented in the direction of insertion to grip and engage the contact pin securely to prevent disengagement.

24. The apparatus according to claim 7 wherein said electronic comparator circuit is mounted on a pair of generally circular circuit boards coaxially mounted over and onto a socket contact which mechanically and electrically engages a pin contact on said detonator cup in said armed position.

25. The apparatus according to claim 24 wherein said circuit boards are spaced apart by a generally tubular spacer having an H shaped cross section.

26. The apparatus according to claim 25 wherein said second housing contains said circuit boards and said socket contact and an adjustment plug threadably mounted in said second housing engaging said socket contact sleeve to compensate for manufacturing tolerances in said boards and said spacer within said second housing.

27. A self powered fuze apparatus adapted for use in a projectile having a central axis and containing an explosive charge, said apparatus comprising:

a detonator cup supported in said apparatus so that it is adapted to be shielded from said charge to be exploded in an unarmed position and adapted to communicate with said charge to be exploded in an armed position;

a first housing containing a mechanical safety device for releasably preventing undesired movement of said detonator cup from said unarmed to said armed position, and a second housing adjacent said first housing containing an electronic safety device electrically coupled to said mechanical safety device for sensing a target impact and selectively passing a piezoelectrically generated firing current to said detonator cup only upon sensing a target impact of a predetermined magnitude only within a predetermined time after sensing a predetermined launch acceleration value, said electronic device being electrically and mechanically connected to said detonator cup only when said cup is in said armed position, said electronic safety device including delay means for passing said piezoelectrically generated current to said detonator cup only after a predetermined time after said impact.

28. The apparatus according to claim 27 wherein said electronic safety device comprises a first piezoelectric sensor supported in said first housing so as to generate an electrical charge only upon forward acceleration of said projectile along said axis.

29. The apparatus according to claim 28 wherein said electronic safety device further comprises a second piezoelectric sensor positioned against a front end of said first housing, said second-sensor utilizing the mass of said first housing and said mechanical safety means to generate an electrical charge only upon deceleration of said projectile along said axis against a target.

30. The apparatus according to claim 29 further comprising an electronic comparator circuit for comparing the electrical charges generated by said first and second sensors to electrically determine whether to pass said second sensor charge as said current to said detonator cup.

31. The apparatus according to claim 30 wherein said detonator cup has an outwardly projecting pin contact adapted to receive a spring biased socket contact connected to said electronic safety device only when said cup is in the armed position, said socket contact sliding over said pin contact and gripping said pin contact sufficiently to prevent contact jump during target impact.

32. The apparatus according to claim 31 wherein said socket contact is movably supported within a stationary contact sleeve electrically connected to said comparator circuit.

33. The apparatus according to claim 32 wherein said socket contact is axially disposed within said second housing.

34. The apparatus according to claim 33 wherein said socket contact has an internal extension spring inside both the sleeve and the socket contact.

35. The apparatus according to claim 34 wherein said socket contact has internally projecting barbs oriented to grip and engage the contact pin securely to prevent said contact jump.

36. A projectile comprising:

an explosive charge and a self powered fuze apparatus to detonate said charge comprising:

a detonator cup supported in said apparatus so that it is adapted to be shielded from said charge to be exploded in an unarmed position and adapted to communicate with said charge to be exploded in an armed position;

a first housing containing a mechanical safety lo device for releasably preventing undesired movement of said detonator cup from said unarmed to said armed position; and a second housing adjacent said first housing containing an electronic safety device electrically coupled to said mechanical safety device for sensing and selectively passing a sensor generated current to said detonator cup only upon sensing an impact of a predetermined magnitude within a predetermined time after sensing a predetermined launch acceleration value, said electronic safety device being electrically and mechanically connected to said detonator cup only when said cup is in said armed position.

37. The projectile according to claim 36 wherein said electronic safety device comprises a first self powered sensor and a second self powered sensor for generating said current.

38. The projectile according to claim 37 wherein said sensors are piezoelectric cells.

39. The projectile according to claim 37 further comprising a support housing containing said first and second housings for relative movement of said first and second housings therein in response to acceleration forces.

40. The projectile according to claim 37 wherein said electronic safety device wherein said first sensor comprises a first piezoelectric sensor being positioned so as to generate a first electrical charge only upon forward acceleration of said projectile along said axis.

41. The projectile according to claim 40 wherein said second sensor comprises a piezoelectric sensor positioned so as to utilize the mass of said first housing and said mechanical safety device to generate a second electrical charge only upon deceleration of said explosive device.

42. The projectile according to claim 41 wherein said electronic safety device further comprises an electronic comparator circuit for comparing the electrical charges generated by said first and second sensors to electrically determine whether to pass said second sensor charge as a current to said detonator cup.

43. The projectile according to claim 40 wherein said first sensor is supported in a coaxial bore in said first housing.

44. The projectile according to claim 43 wherein said first sensor comprises a heavy rod slidably supported in said bore, said rod having one end movable against one side of a piezoelectric cell fixed in said bore, and an electrical contact connecting another side of said cell to said comparator circuit.

45. The projectile according to claim 44 wherein said piezoelectric cell is a flat sided body of a piezoelectric material contained within an insulating box within said first housing.

46. The projectile according to claim 45 further comprising an area multiplier between said rod and said piezoelectric cell.

47. The projectile according to claim 37 wherein said second sensor is an annular disk of piezoelectric material supported against forward movement by said explosive device.

48. The projectile according to claim 47 wherein said first and second housings are slidably supported within said explosive device so that upon target impact, the mass of both said housings bears upon said second sensor to generate said second sensor current.

49. The projectile according to claim 48 wherein said disk has a metal washer contact fastened to one side of said disk and electrically connected to said comparator circuit.

50. The projectile according to claim 37 wherein said electronic safety device further comprises a cup shaped housing containing a pair of generally circular printed circuit boards stacked and spaced from each other by a generally disk shaped insulating spacer having a tubular rim.

51. The projectile according to claim 50 wherein said first and second sensors are each connected to one of said circuit boards.

52. The projectile according to claim 51 wherein said circuit boards are connected together by a central sleeve containing a spring biased socket contact adapted to engage said detonator cup in said mechanical safety device.

53. The projectile according to claim 52 wherein said first sensor further includes a pin contact having a flat end surface contacting a piezoelectric block and a pin projecting out of said mechanical safety device into another socket contact mounted on one of said circuit boards.

54. A projectile comprising:

explosive charge and a self powered fuze apparatus to detonate said charge comprising:

a detonator cup supported in said apparatus so that it is adapted to be shielded from said charge to be exploded in an unarmed position and adapted to communicate with said charge to be exploded in an armed position automatically upon sensing a predetermined projectile launch acceleration;

an electronic safety device selectively electrically coupled to said detonator cup, said device sensing and selectively passing a sensor generated current to said detonator cup only upon sensing an impact of a predetermined magnitude within a predetermined time after separately sensing said predetermined launch acceleration, said electronic device being electrically and mechanically connected to said detonator cup only when said predetermined launch acceleration has been sensed.

55. The projectile according to claim 54 wherein said electronic safety device comprises a first self powered sensor and a second self powered sensor for generating said current.

56. The projectile according to claim 54 wherein said sensors are piezoelectric cells.

57. The projectile according to claim 56 wherein said first sensor comprises a first piezoelectric sensor positioned so as to generate a first electrical charge only upon forward acceleration of said projectile along said axis.

58. The projectile according to claim 57 wherein said second sensor comprises a second piezoelectric sensor positioned so as to generate a second electrical charge only upon deceleration of said projectile.

59. The projectile according to claim 58 wherein said electronic safety device further comprises an electronic comparator circuit for comparing the electrical charges generated by said first and second sensors and a logic circuit to electrically determine whether to pass said second sensor charge as a current to said detonator cup.

60. The projectile according to claim 59 wherein said safety device further comprises a dud safe circuit receiving an initial charge from said first sensor and providing an output signal to said logic circuit only when said initial first sensor charge is above a threshhold value and within a predetermined percentage of its initial value.

61. The projectile according to claim 60 wherein said percentage is determined by a preselected resistor and capacitor discharge time constant.

62. The projectile according to claim 61 wherein said safety device further comprises discriminator switch circuit adapted to prevent a first charge generated by said first piezoelectric sensor, generated subsequent to a second charge generated by said second sensor, provided said second charge is greater than a predetermined threshold value, from reaching said dud safe circuit.

63. A spring biased socket contact for mating with a pin contact of a detonator cup, said socket contact comprising a contact sleeve slidably supporting a generally tubular contact body having a hollow socket portion, a sleeve portion and a transverse partition between said portions, said socket portion having a plurality of inwardly directed prongs to permit insertion of said pin contact, engage said pin contact and prevent disengagement of said pin contact under shock loading.

64. The contact according to claim 63 further comprising a coil spring within said said sleeve and said sleeve portion for urging said body over said pin contact to engage said prongs with said pin contact.

* * * * *

UNITED STATES PATENT AND TRADEMARK OFFICE

CERTIFICATE OF CORRECTION

PATENT NO. : 5,269,223

DATED : December 14, 1993

INVENTOR(S) : Mattsson et al.

It is certified that error appears in the above-identified patent and that said Letters Patent is hereby corrected as shown below:

On the Title Page at section [73], please delete "Ems-Patvag, Domat, Switzerland" and insert at [73] Assignee:

---EMS-Patvag, Domat, Switzerland.
Physics International Company, San Leandro, California
Zaugg Elektronik AG, Lohn, Switzerland---

Signed and Sealed this

Eighteenth Day of March, 1997

Attest:

Bruce Lehman

BRUCE LEHMAN

Attesting Officer

Commissioner of Patents and Trademarks